US007948398B2

(12) United States Patent
Miller

(10) Patent No.: US 7,948,398 B2
(45) Date of Patent: May 24, 2011

(54) LED TRAFFIC SIGNAL WITHOUT POWER SUPPLY OR CONTROL UNIT IN SIGNAL HEAD

(75) Inventor: David D. Miller, Austin, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 469 days.

(21) Appl. No.: 11/822,343

(22) Filed: Jul. 5, 2007

(65) Prior Publication Data

US 2009/0009362 A1 Jan. 8, 2009

(51) Int. Cl.
*G08G 1/095* (2006.01)

(52) U.S. Cl. ..... 340/907; 340/653; 116/63 R

(58) Field of Classification Search ..... 340/653, 340/654, 468, 469, 906, 907; 116/63 R, 116/63 P, 63 C, 63 T
See application file for complete search history.

(56) References Cited

U.S. PATENT DOCUMENTS

| | | | | |
|---|---|---|---|---|
| 4,329,625 | A * | 5/1982 | Nishizawa et al. | 315/158 |
| 5,896,084 | A * | 4/1999 | Weiss et al. | 340/468 |
| 6,236,331 | B1 * | 5/2001 | Dussureault | 340/815.45 |
| 6,567,171 | B1 * | 5/2003 | Rushing | 356/432 |
| 6,614,358 | B1 * | 9/2003 | Hutchison et al. | 340/815.45 |
| 7,301,447 | B2 * | 11/2007 | Patel | 340/475 |
| 7,376,983 | B1 * | 5/2008 | Sciarrino | 4/288 |
| 7,378,983 | B2 * | 5/2008 | Wang et al. | 340/815.45 |
| 2005/0063182 | A1 | 3/2005 | Birch et al. | |
| 2005/0243556 | A1 * | 11/2005 | Lynch | 362/276 |

* cited by examiner

*Primary Examiner* — George A Bugg
*Assistant Examiner* — Edny Labbees
(74) *Attorney, Agent, or Firm* — Michael J. Wallace, Jr.

(57) ABSTRACT

A traffic signal is provided for controlling vehicular traffic. The traffic signal includes a light source (10) having a light emitting diode (LED) array (D1, D2, D3, D4). A power regulator (14) is associated with the light source and is constructed and arranged to control input current to the light source. A traffic signal controller (16) is remote from the light source and the power regulator. The traffic signal controller is constructed and arranged to provide an input voltage signal to the power regulator, with the input current being based on the input voltage signal.

21 Claims, 3 Drawing Sheets

LED TRAFFIC SIGNAL WITHOUT POWER SUPPLY OR CONTROL UNIT IN SIGNAL HEAD

FIELD OF THE INVENTION

This invention relates to light emitting diode (LED) traffic signals, and more particularly, to a method of powering an LED traffic signal without the use of a power supply or control unit in the signal head.

BACKGROUND OF THE INVENTION

A conventional traffic signal employs a power supply and control electronic module located inside the traffic signal head. This configuration has the following limitations:

The conventional power supply and control module are located in an environmentally unfriendly location. The signal head is exposed to direct sunlight without proper ventilation, meaning it is exposed to extremes in temperature. Worse, if the power supply and control module fails, traffic lanes must be closed and the repair made using a "bucket truck" to reach the signal head.

Since the conventional control module is located in the signal head, information must be communicated from the control module to the traffic signal controller mounted in an electrical cabinet beside the roadway. To accomplish this, a separate communications line must be installed, or the information must be superimposed on the existing traffic signal electrical wires, or the information must be transmitted via a wireless method.

Since a high-frequency switching regulator is enclosed in a metal electrical cabinet at the street corner, the radiated electrical noise created by the switching circuitry must be shielded from the radios of passing motorists by the metal electrical cabinet, and is not placed overhead with high-frequency radio emissions.

Since conventional traffic signal control is configured to detect malfunctioning incandescent bulbs by measuring signal head voltage, measuring the signal head voltage of an LED signal does always detect a malfunction, as the LED gradually loses light output, even with proper voltage levels applied.

Since the conventional control module is located in the signal head, and communications from the signal head to the traffic signal controller is generally not available, or not affordable, the conventional signal head responds to a calculated end-of-life by breaking a fuse to emulate a "burned-out" incandescent bulb. This method has two disadvantages:

1. Abrupt loss of traffic signal causes an unsafe condition for drivers
2. Historically, the method to emulate a "burned-out" bulb frequently malfunctions and causes the signal to prematurely fail.

Traditionally, the old-style traffic signal bulb filaments would simply burn out at the end of the bulb life. Special monitoring circuitry connected to the wire feeding power from the traffic signal controller to the signal head senses the voltage across the bulb. If the bulb filament is intact, the voltage measured across the bulb is essentially zero. If the filament is burned-out, the lamp switch leakage is no longer connected through the filament, and the voltage across the bulb is large, indicating the dangerous condition to the Traffic Control Center. This sensor might also place the intersection into FLASH RED in the opposing direction, to insure motorist safety. The Traffic Control Center would then schedule a service call to replace the bulb.

Currently, the incandescent bulbs of traffic signals are being replaced by LED light sources, with the advantage of much lower power and longer life. Because incandescent bulbs emit tungsten light, consisting of a broad color spectrum, only a small portion of the light is passed through a color filter to the driver. LEDs emit monochrome light. For example, a RED LED emits RED light, meaning that the power to produce only light of the desired color is much less. Because LEDs do not operate on the normal power line voltage (120 VAC, 60 Hz in the US, for example), a power supply is embedded in each signal head to convert the power line voltage to the lower voltage and current required by the LED light source. However, because LED light sources do not "burn out" as do light bulbs, another problem is created. As the LED light source ages, its light output gradually decreases, to the point of creating a dangerous condition. Worst, after the LED light output has reached a dangerously low level, no corresponding loss of signal voltage or current alerts the traffic signal controller to the danger. To counteract this problem, a control module is installed in each signal head. Different methods are used by the control module to sense the end-of-life for the LED light source. In one method, the LED light source brightness is measured by the control module using a photo sensor, such as a photo diode, photo transistor, or cadmium sulfide cell. As the light output falls with age or temperature, the control module increases power to the LED light source to compensate.

Once the control module determines that the LED light source has reached the end of its life, different methods are used to inform the Traffic Control Center, among them:

1. A fuse is installed in the signal head, in series with the LED light source. Once the control module determines that the LED light source has reached the end of its life, the control module will "blow" the fuse, simulating a bulb burning out. The traffic signal controller senses the loss of signal head power and indicates the event to the Traffic Control Center.
2. A communications link is added that connects the control module of each signal head to the traffic signal controller. Once the control module determines that the LED light source has reached the end of its life, the control module will communicate this information to the traffic signal controller and the Traffic Control Center via the communications link. This communications link might take the form of a separate set of wires, a signal superimposed on the power line to the signal head, or wireless, such as radio or infrared.

Thus, the conventional traffic signal has disadvantages, with some of the disadvantages listed below:

Each signal head includes a power supply, which adds expense, is prone to failure and is located overhead, where servicing and replacement are inconvenient at best and dangerous to the motorist at worst.

To maintain LED signal efficiency, the power supply installed in each signal head employs a switching regulator. This type of regulator increases or decreases the LED light output by switching the LED light source ON and OFF at a rapid rate (usually about 20,000 times per second). The light output is controlled by varying the amount of ON time relative to OFF time (duty-cycle). While very efficient, this method naturally transmits this switching frequency into the air, causing potential interference with radios and emergency communications. To counteract this problem, various noise-suppression and shielding techniques are required.

The end-of-life indication method of "blowing" a fuse provides no prior warning, meaning that the fuse may blow in the middle of rush hour, disabling a vital traffic signal. This method could endanger the public until the signal is replaced.

The end-of-life indication method of "blowing" a fuse frequently malfunctions and "blows" prematurely, especially during conditions of lightning surges.

The end-of-life indication method employing communications adds cost and complexity, including the possible installation of additional wires for communications lines.

Thus, there is a need to eliminate the power supply and control module in the signal head of a traffic signal.

SUMMARY OF THE INVENTION

An object of the invention is to fulfill the need referred to above. In accordance with the principles of the present invention, this objective is achieved by providing a traffic signal for controlling vehicular traffic. The traffic signal includes a light source having a light emitting diode (LED) array. A power regulator is associated with the light source and is constructed and arranged to control input current to the light source. A traffic signal controller is remote from the light source and the power regulator. The traffic signal controller is constructed and arranged to provide an input voltage signal to the power regulator, with the input current being based on the input voltage signal.

In accordance with another aspect of the invention, a method of controlling a light source including at least one light emitting diode (LED) provides a DC input voltage from a source to a power regulator associated with the light source. The source is remote from the light source and the power regulator. The power regulator provides, based on the DC input voltage, an input current to the light source to illuminate the LED. The input current is varied based on certain conditions associated with the light source.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
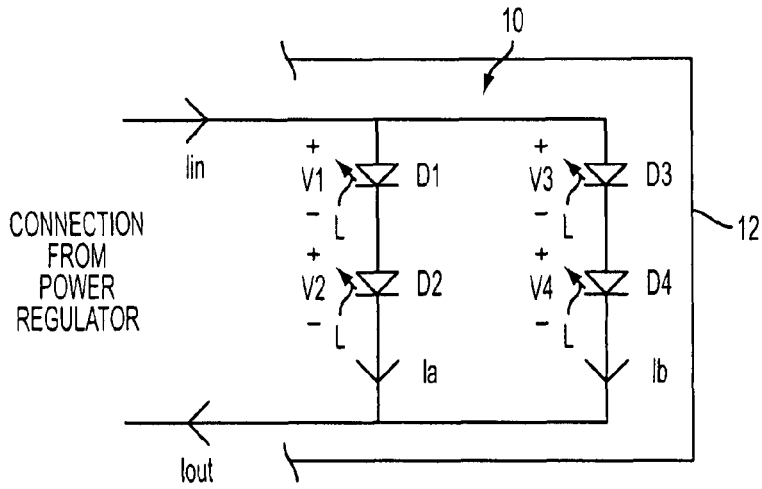
FIG. 1 is a schematic diagram of a light source including an LED array in accordance with an embodiment of the present invention.

A light source, a power regulator, and a control algorithm define an LED traffic signal in accordance with the principles of an embodiment of the invention. With reference to FIG. 1, the light source, generally indicated at 10, includes an LED array mounted in a traffic signal housing 12, and installed in the traditional manner to control vehicular traffic at roadway intersections. The LED array includes one or more individual LEDs, connected in a series, a parallel, or a combination of a series/parallel connection as shown in FIG. 1. In the embodiment, the LED array includes four LEDs, identified as D1, D2, D3 and D4. The illustrated LED array is powered by a current source identified as Iin, which is generated by a power regulator 14 that will be described below. The current source Iin splits into two branch currents identified as Ia and Ib. After flowing through LEDs D1, D2, D3 and D4, the two branch currents Ia and Ib flow into one drain current identified as Iout.

Applying Kirchhoff's Current Law:

$$\Sigma \mathrm{Iin} = \Sigma \mathrm{Iout}$$

$$I\mathrm{in} = Ia + Ib = I\mathrm{out}$$

Therefore, as long as Iin=Iout, current is flowing though each of the four LEDs, meaning the traffic signal is in the ON state and emitting light of the proper color. Again, in the embodiment of FIG. 1, four LEDs are employed, configured as two parallel branches of two series LEDs. Any number of other topologies consisting of one or more LEDs may be used for the light source 10. In each possible topology, the current flowing though each LED is a branch current that can be represented by Kirchhoff's Current Law, including the branch currents flowing though each LED, as well as the source or input current and the drain current through the entire LED array.

As shown in FIG. 1, the LEDs identified as D1, D2, D3, and D4 each have a voltage drop identified as V1, V2, V3 and V4, respectively. The power consumed by each LED is the mathematical product of voltage drop multiplied by the branch current. The power consumed by each LED consists of two components, light (identified by the photon emission arrows L of FIG. 1), and heat. The light component illuminates the traffic signal, while the parasitic heat component must be dissipated to prolong the life of the LED. For example, the power consumed by D1 is:

$$P_{D1} = V1 \times Ia$$

As the branch current is increased through each LED, the voltage across each LED remains essentially constant, meaning that both the light and heat output of each LED increases with increasing branch current.

Unlike a traditional incandescent light bulb, LEDs do not "burn out" abruptly at the end of their useful life. Rather, the light emitted from an LED gradually decreases with age, meaning that at a constant branch current and constant temperature, the light output of an LED traffic signal will gradually decrease with age to an unsafe level that is too dim to be recognized by a driver.

In addition, the light output of an LED is inversely proportional to temperature, meaning that the light output decreases in hot weather, and will permanently age much more quickly with exposure to hot weather. Since high temperatures decrease LED light output, which necessitates additional current, which increases heat, the LED branch current must be controlled to maintain a safe light output. Therefore, the LED current can be decreased during conditions of cool ambient temperatures to increase the LED life.

To obtain maximum LED life, the LED can be dimmed at night, during conditions of minimum ambient light. Since the human eye dilates during low ambient light, the perceived LED contrast remains constant with a much lower light output at night. Conversely, with the sun situated low on the horizon, a driver facing the sun must contend with constriction of the human eye, meaning that the traffic signal will be much more difficult to see. For safety, the LED light output could be increased during sunrise and sunset.

Furthermore, a traffic signal facing the sun low on the horizon suffers from a phenomenon known as "sun phantom" meaning that the sunlight from behind the driver is reflected by the traffic signal back towards the driver, making the signal appear to be ON when it is actually OFF. Increasing the traffic signal light output during sunrise and sunset increases the contrast between the ON signal head and the OFF signal heads, as the reflected sun phantom of the OFF signal heads remains constant.

In addition to ambient temperature and light, driver safety in other adverse weather conditions, such as fog, snow and rain can benefit by increased light output to improve the traffic signal contrast.

As described above, the light output of the light source 10 is increased by increasing the input current Iin, while the light output of the light source 10 is decreased by decreasing the input current Iin. In addition, as long as the non-zero input current Iin is equal to the return current Iout, the light source 10 is working and emitting light. Therefore, with reference to FIG. 2, a power regulator, generally indicated at 14, serves two functions: Current Control and Fault Detection. The power regulator 14 is preferably provided in the traffic signal housing 12.

Figure 2:
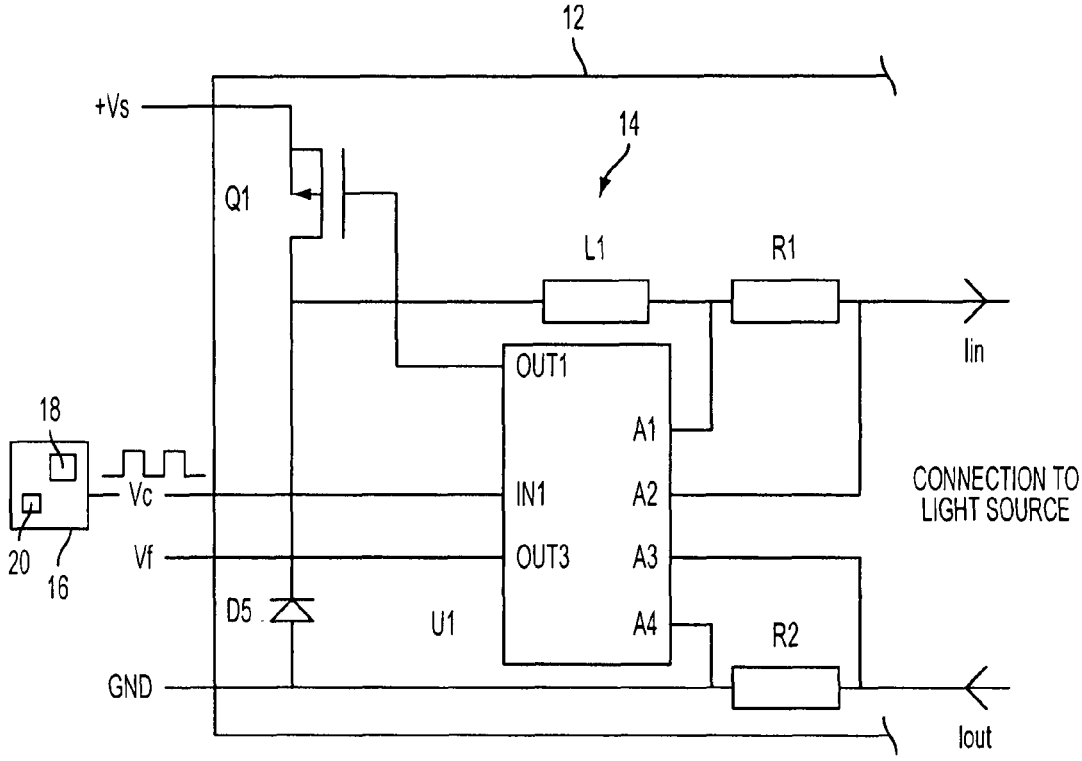
FIG. 2 is a schematic diagram of a power regulator circuit in accordance with an embodiment of the present invention.

The current control circuitry controls the input current flowing to the light source (Iin), based on a signal Vc from a Traffic Signal Controller 16. In the embodiment of FIG. 2, the Traffic Signal Controller 16 issues a fixed-frequency, variable duty-cycle signal Vc to the power regulator 14 that indicates the amount of current to be applied to the light source 10. For example, if Vc is constantly a logic "0", the power regulator 14 will apply no current to the light source 10. If Vc is constantly a logic "1", the power regulator 14 will apply full-scale current to the light source 10. If Vc is a logic "1" 25% of the time, and a logic "0" 75% of the time, the power regulator 14 responds by applying 25% of full-scale current to the light source 10. The full-scale current is chosen to match the light source 10 used.

Vc is sensed by the microcontroller U1, which responds by placing a second fixed-frequency, variable duty-cycle signal on OUT1. The OUT1 signal then turns a P-Channel Metal Oxide Silicon Field Effect Transistor (PMOSFET) Q1 ON and OFF in the same proportional duty-cycle to match the duty-cycle of Vc. When Q1 is ON, diode D5 is back-biased and has negligible effect, and the inductor L1 is connected to voltage Vs. Since L1 cannot allow the current Iin to change instantaneously, Iin begins to increase as a natural logarithm. As Iin increases, the voltage across R1 increases according to Ohm's Law:

$$V = I\text{in} \times R1$$

The voltage at one end of R1 is measured by U1 at analog input A1, while the voltage at the other end of R1 is measured by U1 at analog input A2. U1 then subtracts the voltage at A2 from the voltage measured at A1. Because the value of R1 is set in U1 memory, Iin is calculated by U1 using Ohm's Law. U1 leaves Q1 set to ON until the current prescribed by the Vc duty-cycle is reached. At that point, U1 sets Q1 to OFF. Because the current Iin cannot change instantaneously, and must continue to flow while Q1 is OFF, Iin will continue to flow through the Light Source and travel back to the Power Regulator as Iout, which then forward-bias D5, which then directs Iout back to the light source 10 as Iin in a circular fashion. U1 leaves Q1 set to OFF for the portion of the duty-cycle prescribed by signal Vc. Once the Q1 OFF time expires, U1 then turns Q1 ON, and the cycle repeats. Using this method, the current flowing to the light source 10 can be set by the Traffic Signal Controller 16 via signal Vc.

Vs is a DC voltage provided by a separate power supply 20 of the Traffic Signal Controller 16 that converts 120 VAC (or other service voltage if outside the US) to a DC voltage used by the power regulator 14. This is a single power supply 20 located remotely in the electrical cabinet at the street corner, versus a separate power supply located in each signal head that is required by conventional LED traffic signals.

One method used by U1 to detect faults is by simply measuring the drain current (Iout) that returns from the light source 10. The returned drain current is measured by U1 by measuring the voltage across R2 using analog inputs A3 and A4. Again, since the value of R2 is stored in U1 memory, U1 calculates the drain current returned from the light source 10. As long as the drain current (Iout) returned from the light source 10 is approximately equal to the input current (Iin), the light source is functioning. If Iin is not approximately equal to Iout while the light source 10 is intended to be ON, the light source is not working correctly, due to a broken wire or current leakage. Conversely, if Iin or Iout current flow is detected while the light source 10 is intended to be OFF, the light source is not working correctly due to a leakage path. Detected fault conditions are sent via U1 OUT2 to a Traffic Signal Monitor input signal Vf. The Traffic Signal Monitor (not shown) can then alert the Traffic Signal Controller 16 and Central Office (not shown) for service, as well as to place the intersection into a safe state (FLASH, for example). In the embodiment of FIG. 2, a microcomputer is used as U1; however, other electronic circuit design methods could be used to regulate the light input or source current based on Traffic Signal Controller signal(s), as well as to detect fault conditions by measuring Iin and Iout. Other methods may be used to detect faults, in addition to measuring current. For example, the voltage could be measured between the wires connected to the light source to detect an open-circuit condition of the LED array if the voltage is greater than the expected value of V1+V2. Also, a short-circuit condition of the LED array could be detected if the voltage falls below the expected value of V1+V2. Improper wire installation could be detected if the voltage of one wire with respect to the other reverses polarity.

A control algorithm 18 is implemented as executable code stored on a computer readable medium (e.g., a hard disk drive, a floppy drive, a random access memory, a read only memory, an EPROM, a compact disc, etc,) of the device controlling the power regulator, usually the Traffic Signal Controller 16. Thus, the Traffic Signal Controller 16, remote from the light source 10 and power regulator 14 can be any controller that controls the power regulator 14. The control algorithm 18 performs the following three functions:

- Set the correct light source current (Iin), as a function of input terms
- Sense a fault condition indicated by the power regulator Vf signal
- Predict the end-of-life for aged light sources requiring replacement The Traffic Signal Controller calculates the optimum current for the Light Source as a function of the following Input Terms known to the Traffic Signal Control software:

Full-Scale Current
Ambient Temperature
Real Time (year, month, day, hour, minute, second)
Weather Conditions (fog, snow, rain, etc.)
Light Source Age (as a function of current, temperature and hours)

Figure 3:
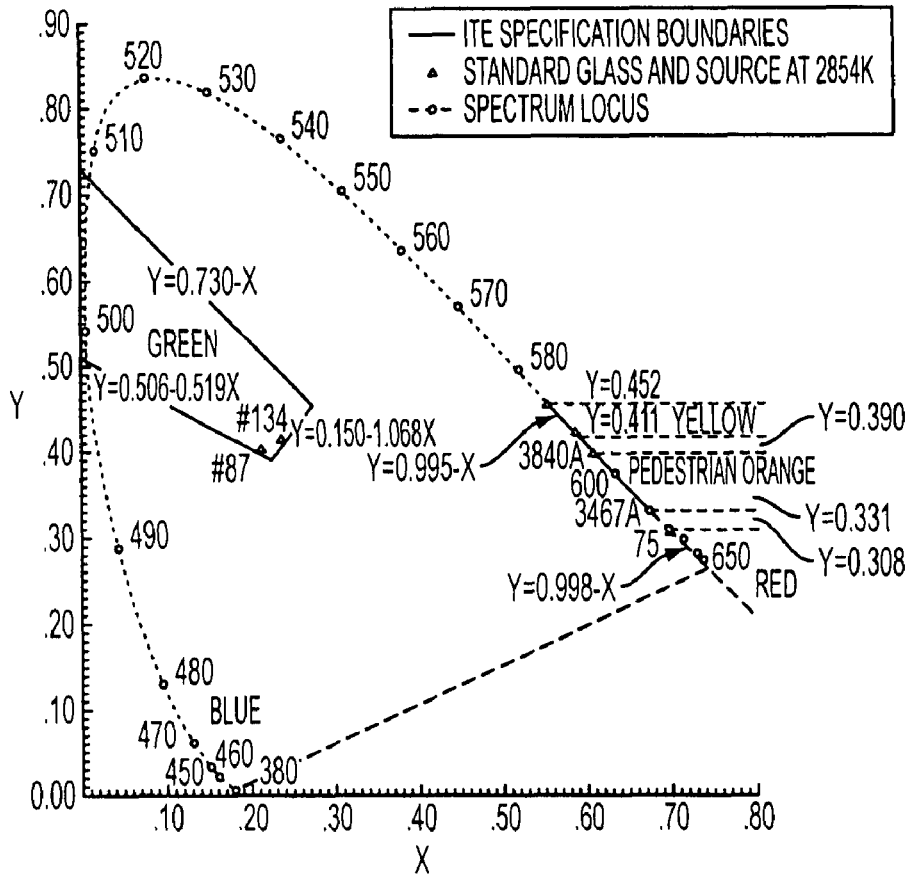
FIG. 3 PRIOR ART
FIG. 3 is a conventional Institute of Transportation Engineers (ITE) chromaticity diagram.

Full-Scale Current (FSC) is the current generated by the power regulator 14 when the signal Vc is set to 100% ON. FSC can be calculated from requirements from the Institute of Transportation Engineers, which specifies the light color temperature for each type of signal, plus the light intensity measured at varying horizontal and vertical axes, as shown in FIG. 3 and Table 1 below.

TABLE 1

Minimum Laboratory Intensity Requirements of Colored Lenses

| Test Point | | Candlepower Values (candelas) | | | | | |
|---|---|---|---|---|---|---|---|
| | | 8-inch Signal | | | 12-inch Signal | | |
| Vertical Angle Down | Horiz. Angle Left & Right | Red | Yellow | Green | Red | Yellow | Green |
| 2.5° | 2.5° | 157 | 726 | 314 | 399 | 1848 | 798 |
| | 7.5° | 114 | 528 | 228 | 295 | 1364 | 589 |
| | 12.5° | 67 | 308 | 133 | 168 | 770 | 333 |
| | 17.5° | 29 | 132 | 57 | 90 | 418 | 181 |
| 7.5° | 2.5° | 119 | 550 | 238 | 266 | 1232 | 532 |
| | 7.5° | 105 | 484 | 209 | 238 | 1100 | 475 |
| | 12.5° | 76 | 352 | 152 | 171 | 792 | 342 |
| | 17.5° | 48 | 220 | 95 | 105 | 484 | 209 |
| | 22.5° | 21 | 99 | 43 | 45 | 209 | 90 |
| | 27.5° | 12 | 55 | 24 | 19 | 88 | 38 |
| 12.5° | 2.5° | 43 | 198 | 88 | 59 | 275 | 119 |
| | 7.5° | 38 | 176 | 76 | 57 | 264 | 114 |
| | 12.5° | 33 | 154 | 67 | 52 | 242 | 105 |
| | 17.5° | 24 | 110 | 48 | 40 | 187 | 81 |
| | 22.5° | 14 | 65 | 29 | 26 | 121 | 52 |
| | 27.5° | 10 | 44 | 19 | 19 | 88 | 38 |
| 17.5° | 2.5° | 19 | 88 | 38 | 26 | 121 | 52 |
| | 7.5° | 17 | 77 | 33 | 26 | 121 | 52 |
| | 12.5° | 12 | 55 | 24 | 26 | 121 | 52 |
| | 17.5° | 10 | 44 | 19 | 26 | 121 | 52 |
| | 22.5° | 7 | 33 | 14 | 24 | 110 | 48 |
| | 27.5° | 5 | 22 | 10 | 19 | 88 | 38 |

Figure 4:
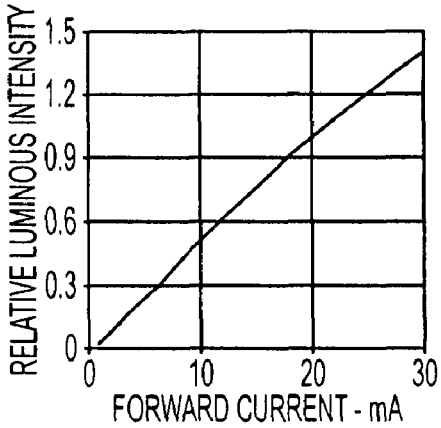
FIG. 4 PRIOR ART
FIG. 4 is a conventional diagram of forward current vs. luminous intensity needed to meet ITE requirements.

Since the color temperature, light intensity and light dispersion patterns are known for each signal type, the light source 10 can readily be configured by matching the light requirements of the signal to the data sheets provided by the manufacturers of LEDs, which include light color temperature and light dispersion, plus light intensity as a function of current, temperature and age. Once the light source 10 is configured, the FSC can be calculated from the input terms in the formula below. The example shown in FIG. 4 was obtained from the Agilent HLMP-CW data sheet. FIG. 4 depicts the Forward Current required for the desired Luminous Intensity needed to meet the ITE requirements. In this case, the formula is:

$$Iin=20.83Li$$

Since the Luminous Intensity required to meet the ITE requirements is known, and the number of LEDs used in the light source 10 is known, the amount of current Iin can be set by the Traffic Signal Controller 16 via the power regulator 14.

Figure 5:
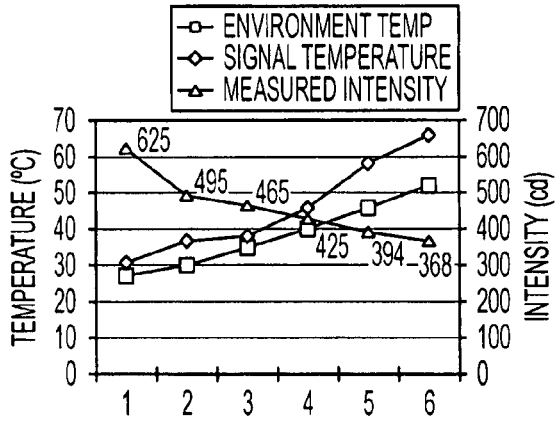
FIG. 5 PRIOR ART
FIG. 5 is a conventional diagram of luminous intensity vs. ambient temperature from the Florida Engineering Research Laboratory Repot 4.1.2.01.

FIG. 5 depicts the effect on Luminous Intensity versus Ambient Temperature, from the Florida Traffic Engineering Research Laboratory Report 4.1.2-01. As can be seen, the Luminous Intensity drops by approximately 100 candelas for every 10 degrees C. increase in ambient temperature. Since the ambient temperature is known to the Traffic Signal Controller 16, Iin can be lowered during cool temperatures to increase the life of the light source 10 while maintaining the Luminous Intensity.

Since the time of day is known to the Traffic Signal Controller 16 by year, month, day, hour, minute and second, the Luminous Intensity can be adjusted by varying Iin. For example, the Luminous Intensity can be lowered at night to prolong the life of the light source, and increased during sunrise and sunset to increase the contrast.

Since adverse weather conditions are known to the Central Transportation Control Center (not shown), and since the Central Transportation Control Center is connected to the Traffic Signal Controllers 16, the Luminous Intensity can be increased during adverse weather conditions, such as fog, rain, snow, smoke, etc.

Figure 6:
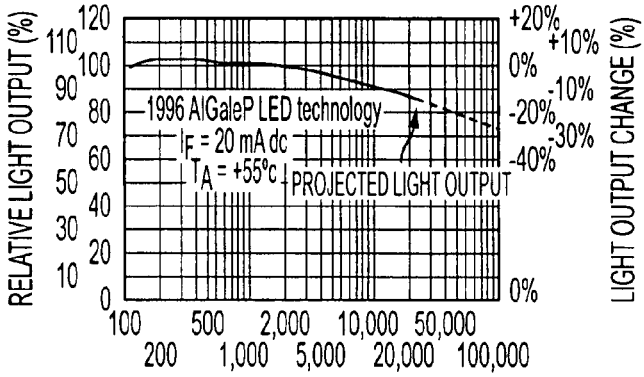
FIG. 6 PRIOR ART
FIG. 6 is a conventional diagram from Agilent Technologies, Inc showing degradation of luminous intensity vs. on-time hours at a fixed Iin and constant ambient temperature.

FIG. 6 depicts the degradation (in percent) of Luminous Intensity versus ON-Time Hours at a fixed Iin and constant ambient temperature, provided by Agilent Technologies, Incorporated. Using FIG. 6, the Traffic Signal Controller 16 can track the ON-Hours of each light source 10. For example, if the light source 10 has been ON a total of 10,000 hours, the Traffic Signal Controller 16 would increase the Luminous Intensity by 10% by increasing the Iin per FIG. 4. Of course, increasing the current shortens the life, as well as increased ambient temperature. Using a composite history of ON-Hours, Iin, and ambient temperature, the end of life can be identified by FIG. 7, from Agilent Technologies.

Figure 7:
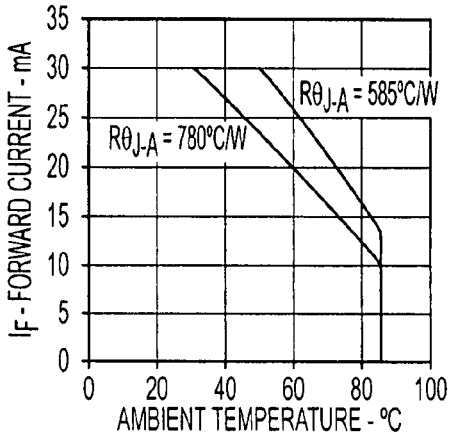
FIG. 7 PRIOR ART
FIG. 7 is a conventional diagram from Agilent Technologies, Inc showing maximum allowable forward current vs. ambient temperature.

When the Traffic Signal Controller 16 calculates the need for Iin that exceeds the allowable Iin depicted in FIG. 7, the light source 10 has reached its end of life and must be replaced. Instead of a sudden "burned out bulb" of the older incandescent bulbs, or the forced "blown fuse" method of prior LED signals, the light source 10 continues to operate safely while the Traffic Signal Controller 16 reports the need to replace the light source 10 via signal Vc.

When the light source 10 is replaced, the ON-Hour record is set to zero in the memory of the Traffic Signal Controller 16, and the light source life-cycle repeats.

Thus, the embodiment provides four major functions: 1) Converts normal power line voltage (120 VAC, 60 Hz in the US for example) to the lower DC voltage and current required by the LED light source, 2) Provides an indication of remaining life of the LED light source, 3) Provides additional safety to motorists by increasing the light output in conditions of fog, snow, or bright sunlight low on the horizon, 4) Saves power and increases the life of the LED light source by adjusting the LED light source in response to life or environmental conditions, 5) Provides an improved method to monitor and detect malfunctioning or miss-wired LED signal heads.

Several advantages of the embodiment are:

1. The signal heads (housing 12) do not require a power supply. Proper power levels to operate the LED light source are provided by the traffic signal controller, reducing cost and eliminating multiple power supplies embedded in signal heads as a source of failure.
2. Signal heads do not require a control module. The LED light source is controlled by the traffic signal controller, reducing cost and eliminating the control module as a source of failure.
3. Signal heads do not contain any high-frequency switching components that might generate radio interference.
4. The end-of-life prediction for each signal head is constantly calculated by the traffic signal controller, displayed on the Traffic Signal Controller display and transmitted to the Traffic Control Center. When an LED light source reaches its end-of-life, that information is used by maintenance personnel to schedule replacement. The LED light source does not "blow" and stop working abruptly, as in some implementations of the prior art.

5. Communications lines or wireless links are not required, as the end-of-life calculation is made by the traffic signal controller, and not the signal head.
6. All electronic circuitry powering and controlling the LED light source is located in the traffic signal controller cabinet, which is cooled by forced-air. This means that the electronic circuitry is far less likely to fail.
7. Failed circuitry can be replaced at the accessible ground-level electrical cabinet, instead of blocking the roadway with a "bucket truck", creating a safer environment for the motorist.

Again, illustrated embodiment is described using example data. It can be appreciated that data for various LED devices other than the data shown here can be employed and the embodiment can accommodate the requirements for various countries other than the ITE requirements for the US described herein. Other methods, other than using a microcontroller U1, may be used to control the source current (Iin) and to detect fault conditions can be used.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A traffic signal, for controlling vehicular traffic, comprising:

a light source including a light emitting diode (LED) array, a power regulator associated with the light source, the power regulator provided in a traffic signal housing and adapted to receive a supply voltage and an input voltage signal and to control an input current to the light source, and a traffic signal controller, provided in a cabinet physically separate from the traffic signal housing, the traffic signal controller adapted to provide the input voltage signal to the power regulator, wherein the power regulator is adapted to measure a voltage generated across a resistance by the input current to the light source and to control the input current to the light source according to the measured voltage and the input voltage signal.

2. The traffic signal of claim 1, wherein the LED array comprises at least one LED.

3. The traffic signal of claim 1, wherein the LED array comprises four LEDs arranged in two parallel branches of two series LEDs.

4. The traffic signal of claim 1, wherein the light source and power regulator are provided together in the traffic signal housing.

5. The traffic signal of claim 1, wherein the traffic signal controller is adapted to provide a fixed-frequency, variable duty-cycle DC signal to the power regulator.

6. The traffic signal of claim 5, wherein the power regulator includes a microcontroller adapted to sense the fixed-frequency, variable duty-cycle signal from the traffic signal controller.

7. The traffic signal of claim 6, wherein the microcontroller is adapted to generate a second fixed-frequency, variable duty-cycle signal in response to sensing the fixed-frequency, variable duty-cycle signal from the traffic signal controller, where the second fixed-frequency, variable duty-cycle signal is adapted to control a Metal Oxide Silicon Field Effect Transistor (MOSFET) of the power regulator to control the input current flowing to the light source.

8. The traffic signal of claim 1, wherein the power regulator is adapted to detect a fault condition of the light source, and wherein the traffic signal controller is adapted to sense a fault condition indicated by the power regulator and to predict end-of life for the light source.

9. The traffic signal of claim 8, wherein the power regulator is adapted to detect the fault condition by measuring a drain current from the light source and comparing the drain current with an input current to the light source.

10. The traffic signal of claim 8, wherein the power regulator is adapted to detect the fault condition by measuring a voltage to the light source.

11. The traffic signal of claim 1, wherein the traffic signal controller is adapted to calculate optimum input current for the light source as a function of 1) current generated by the power regulator when the input voltage signal is set to 100% ON, 2) ambient temperature, 3) time of day, 4) weather conditions, and 5) an age of the light source.

12. The traffic signal of claim 1, wherein the traffic signal controller is adapted to monitor ON time of the light source.

13. The traffic signal of claim 1, wherein the traffic signal controller is adapted to adjust a luminous intensity of the light source by varying the input current to the light source via the power regulator.

14. The traffic signal of claim 4, wherein the traffic signal housing is adapted to be mounted at an intersection, and the traffic signal controller is adapted to be mounted in a cabinet remote from the traffic signal housing.

15. The traffic signal of claim 5, wherein the traffic signal controller includes a power supply adapted to convert an AC voltage to the fixed-frequency, variable duty-cycle DC signal.

16. A method of controlling a light source including at least one light emitting diode (LED), the method including the steps of:

providing a supply voltage and an input voltage signal, from a source, to a power regulator provided in a traffic signal housing and associated with the light source, the source provided in a cabinet physically separate from the traffic signal housing, the power regulator measuring a voltage generated across a resistance by an input current to the light source and controlling, according to the measured voltage and the input voltage signal, the input current to the light source to illuminate the LED, and varying the input current based on certain conditions associated with the light source.

17. The method of claim 16, wherein the step of varying the input current includes varying the input current based on time of day.

18. The method of claim 16, wherein the step of varying the input current includes varying the input current based on present weather conditions near the light source.

19. The method of claim 16, wherein the step of varying the input current includes varying the input current based on ambient temperature near the light source.

20. The method of claim 16, wherein the step of varying the input current includes varying the input current based on an age of the light source.

21. The method of claim 16, wherein the step of varying the input current includes varying the input current based on a number of hours that the light source had been illuminated.

* * * * *